US010455934B1

(12) United States Patent
Colelli et al.

(10) Patent No.: US 10,455,934 B1
(45) Date of Patent: Oct. 29, 2019

(54) MERCHANDISING SYSTEM

(71) Applicant: DISPLAYS PLUS, INC., Placentia, CA (US)

(72) Inventors: Robert Paul Colelli, Yorba Linda, CA (US); Eric Edward Oberg, Huntington Beach, CA (US)

(73) Assignee: DISPLAYS PLUS, INC., Placentia, CA (US)

( * ) Notice: Subject to any disclaimer, the term of this patent is extended or adjusted under 35 U.S.C. 154(b) by 0 days.

(21) Appl. No.: 16/254,068

(22) Filed: Jan. 22, 2019

(51) Int. Cl.
*A47B 57/04* (2006.01)
*A47F 5/16* (2006.01)
*A47F 5/10* (2006.01)

(52) U.S. Cl.
CPC ..... *A47B 57/04* (2013.01); *A47F 5/105* (2013.01); *A47F 5/16* (2013.01); *A47F 2005/165* (2013.01)

(58) Field of Classification Search
CPC . A47B 57/04; A47F 5/105; A47F 5/16; A47F 2005/165
USPC ..... 248/460, 911, 912
See application file for complete search history.

(56) References Cited

U.S. PATENT DOCUMENTS 2,054,098 A * 9/1936 Rich ..... A47B 23/001 108/1
4,216,936 A * 8/1980 DeSelms ..... A47G 1/142 248/460
4,454,948 A * 6/1984 Spamer ..... A47F 1/12 108/108
4,466,593 A * 8/1984 Odenath ..... A47B 23/04 248/455
5,156,096 A * 10/1992 Lamprey ..... A47B 96/027 108/108
5,806,689 A * 9/1998 Mays ..... A47F 1/12 108/108
5,855,351 A * 1/1999 Cziraky ..... A47B 97/04 248/451
6,152,417 A * 11/2000 Randall ..... A47B 23/001 108/43
8,322,290 B1 * 12/2012 Mignano ..... A47B 23/043 108/157.1
2004/0178156 A1 * 9/2004 Knorring, Jr. ..... A47F 1/12 211/59.2
2007/0240321 A1 * 10/2007 Shapiro ..... B25H 7/00 33/471
2010/0004105 A1 * 1/2010 Peddar ..... A63B 22/20 482/132
2011/0204012 A1 * 8/2011 Eguchi ..... A47F 1/12 211/85.8

* cited by examiner

*Primary Examiner* — Ko H Chan
(74) *Attorney, Agent, or Firm* — Vista IP Law Group LLP

(57) ABSTRACT

A merchandising system includes a deck adjustable to various angles to accommodate merchandise for display on a shelf at such various angles. The system may include a front stop and dividers.

18 Claims, 9 Drawing Sheets

MERCHANDISING SYSTEM

BACKGROUND

The metal shelf has been the backbone of brick and mortar retail stores for almost a century. Today, it is still common for merchandise to be placed onto shelves. Most standard shelves are horizontal to the ground, but some shelves are positioned at a non-zero angle to the around for better consumer viewing and/or to assist in gravity feeding of the merchandise. However, this type of angled shelf is at a fixed angle and cannot be adjusted to accommodate various target angles for various applications. In other words, if a different angle is desired other than the angle of the fixed-angle shelf, then a different fixed angle shelf is needed. There is thus a need for a merchandising system to allow simple and effective placement of merchandise on a shelf at various angles, without having to replace the entire shelf to accommodate the desired angle(s).

SUMMARY OF THE INVENTION

The present invention is a merchandising unit and methods of use thereof. The merchandising unit facilitates presentation of merchandise on a retail shelf using a deck adjustable to various target angles to accommodate merchandise for display on the shelf at such angles. The system includes a deck and one or more pairs of angled supports to be removably attached to the bottom surface of the deck, each pair supporting the deck at a corresponding target angle. The angled supports may have visual indicia on them corresponding to their respective target angles.

The system may also include a front stop to be removably attached to the shelf and to the front of the deck, for retaining merchandise that might otherwise fall off the shelf due to gravity and/or other contact forces. The system may also include dividers for placement on the top surface of the deck to help separate merchandise into various columns, and the deck may have alignment indicia/tally marks at the front and corresponding alignment indicia/tally marks at the back to help align dividers.

A single unit may suffice for certain applications, or multiple units may be placed adjacent each other to cover a wider shelf area as needed, either continuously to cover an entire shelf, or intermittently to cover various sections of the shelf. Likewise, multiple units may be used together with angled supports of differing target angles for applications requiring various shelf space to accommodate merchandise at various angles. The angles may also facilitate gravity feeding of the merchandise, especially when the top surface of the deck is configured to assist in gravity feed, but the present invention may also be used with spring-loaded pusher systems, manual feed systems, and/or other merchandising systems.

Typically each unit will include a deck (preassembled), a front stop (preassembled), a plurality of pairs of angled supports configured to support the deck at differing target angles, and a plurality of dividers. To install a unit, the desired pair of angled supports is removably attached to the bottom surface of the deck, the front stop is removably attached to the shelf using locking tabs or the like, the front of the deck is removably attached to the front stop using locking tabs or the like, and then the angled supports are laid to rest on the shelf to support the deck at the target angle. Dividers may be removably attached to the top surface of the deck. If no front stop is used, the angled supports are simply laid to rest on the shelf without attaching the deck to a front stop.

The system has a relatively flat profile which facilitates shipping. Further, the system (preassembled deck, preassembled front stop, angled supports, and dividers) can be assembled for use on location and installed on conventional shelving such as gondola and refrigerator coolers in minutes without tools. These and other advantages as described herein will be apparent to a person of ordinary skill in the art, when read in conjunction with the attached drawings.

DRAWINGS

DETAILED DESCRIPTION

Figure 1:
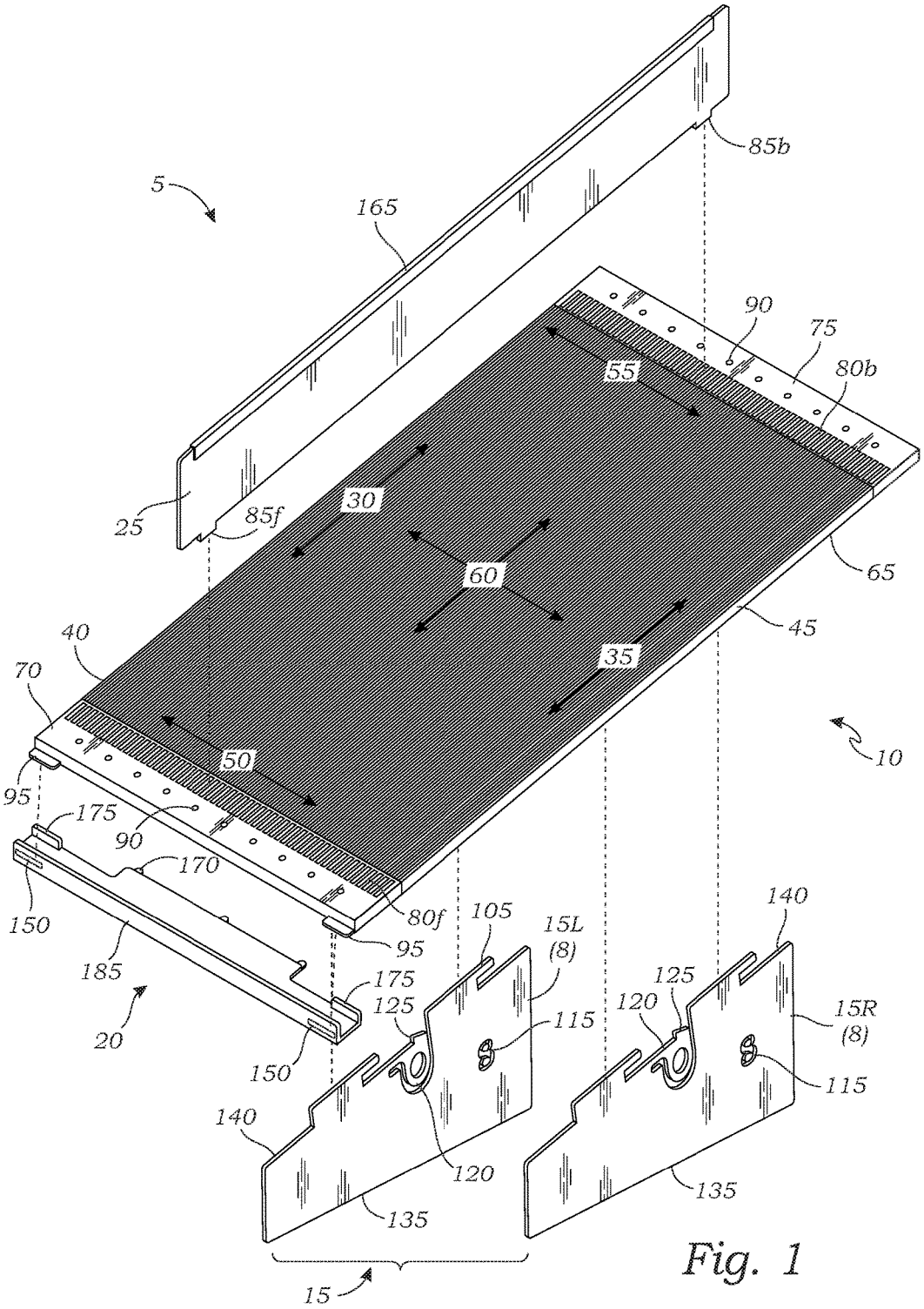
FIG. 1 is a top perspective exploded view of a merchandising system in accordance with an embodiment of the present invention.
Figure 2:
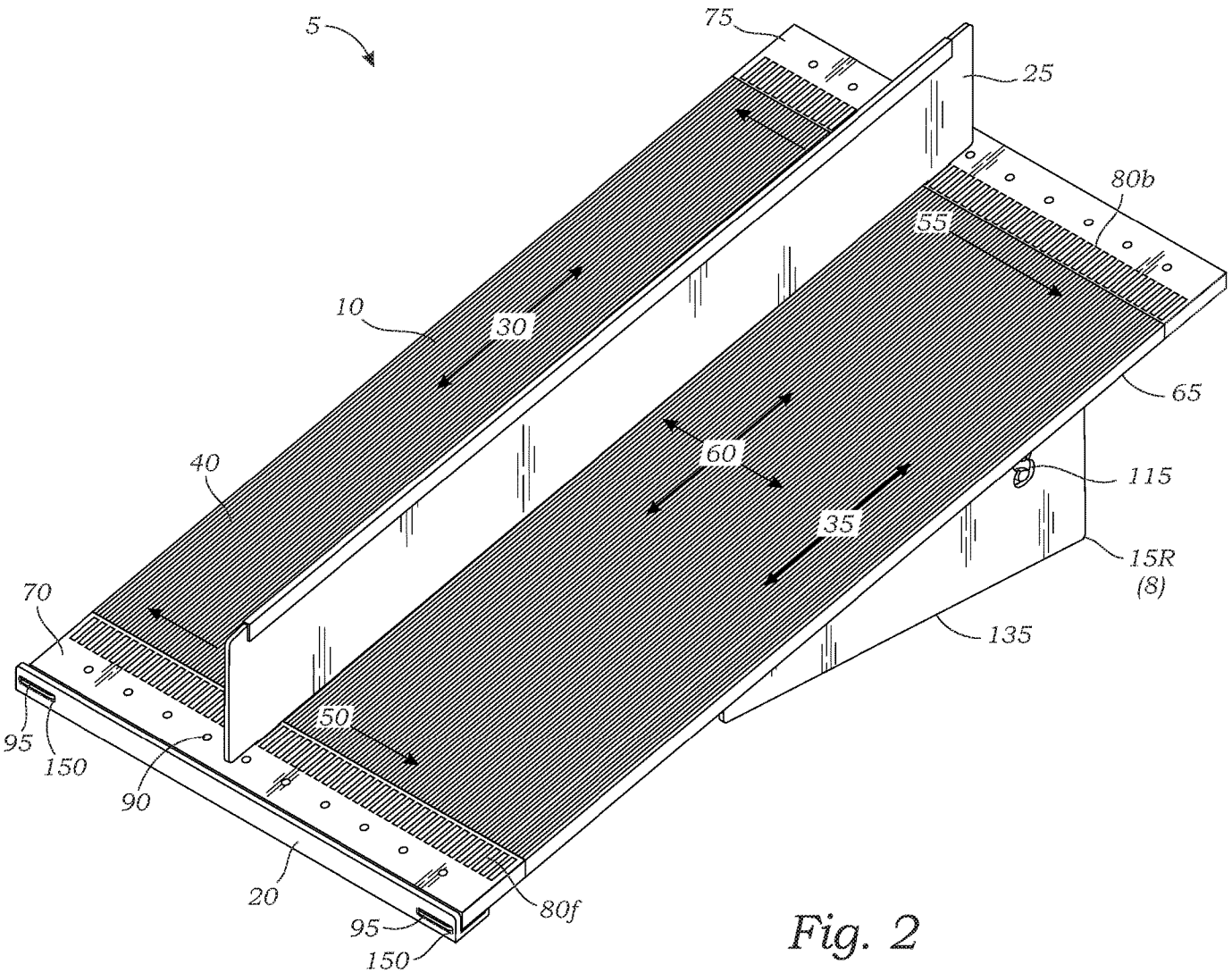
FIG. 2 is a top perspective assembled view of the merchandising system of FIG. 1.

FIG. 1 shows an exploded (unassembled) view of a merchandising system 5 in accordance with an embodiment of the present invention. The system 5 includes a deck 10, one or more pairs of angled supports 15, a front stop 20, and one or more dividers 25. FIG. 1 shows only one pair of angled supports 15L(8) and 15R(8). Reference number 15 is used herein to refer to a single angled support (e.g., 15L(x)) and/or a pair of angled supports (e.g., 15L(x) and 15R(x)) depending on the context. The L and R references refer to Left and Right respectively for convenience, although two angled supports 15 in a matching pair are typically identical and interchangeable. The "(x)" refers to the target angle of the angled support 15. For example, x=8 for the angled supports 15 shown in FIG. 1 since they are configured for a target angle of 8 degrees (as seen by angle indicia 115), and thus are referred to as 15L(8) and 15R(8). The system shown in FIG. 1 is shown in FIG. 2, assembled.

Deck 10 is typically rectangular and flat, and thus has a left side 30, a right side 35, a left edge 40, a right edge 45, a front 50, a back 55, a top surface 60, and a bottom surface 65. Deck 10 is typically 12 inches wide and 18 inches, 20 inches, or 22 inches deep, but may be any dimensions. Deck 10 may be made of plastic, metal, or any suitable material. In one embodiment, top surface 60 comprises a grooved low-friction surface such as a MOTION MAT by Sandee Manufacturing in Franklin Park, Ill., to facilitate gravity feeding of merchandise as the front specimens are removed by consumers. In such a case, the MOTION MAT is affixed to deck 10 by glue and/or other suitable means, typically as part of the factory assembly process. For example, magnets (with corresponding flat washers), or lock washers may be used for easier replacement and maintenance.

Deck 10 has a front panel 70 and a back panel 75 each having correspondingly-aligned connectors (such as slots) 80*f* and 80*b* respectively for receiving complimentary connectors (such as tabs) 85*f* and 85*b* respectively of dividers 25. Deck 10 also has tabs 95 to mate with slots 150 of front stop 20 as explained herein. Panels 70 and 75 may be part of a single-piece deck body, or they may be separate pieces as shown in FIGS. 1-5, and 8, attached by tongue and groove, screws (155), snaps, glue, and/or other suitable means, in which case they would typically be attached as part of the factory assembly process. Panels 70 and 75 may also have corresponding alignment indicia 90 to provide visual reference for installing dividers 25. For example, alignment indicia 90 called out on front panel 70 of deck 10 in FIG. 1 corresponds to alignment indicia 90 called out on the back panel 75 of deck 10 in FIG. 1, as both are fourth from the left edge 40 of deck 10. Indicia 90 may be painted dots, stickers, numbers, or any other suitable visual marker, and may be uniform in appearance, or may vary such that each corresponding pair is more easily matched such as by using different colors for different corresponding pairs. In such a manner, attachment of front connector 85*f* of a divider 25 to one of the front connectors 80*f* of deck 10 at a position relative to an alignment indicia 90 on front panel 70, and attachment of back connector 85*b* of the divider 25 to the corresponding alignment indicia 90 on back panel 75, aligns divider 25 along top surface 60 of deck 10 in parallel relation to left and right edges 40 and 45 of deck 10, as seen in FIG. 2.

Figure 3:
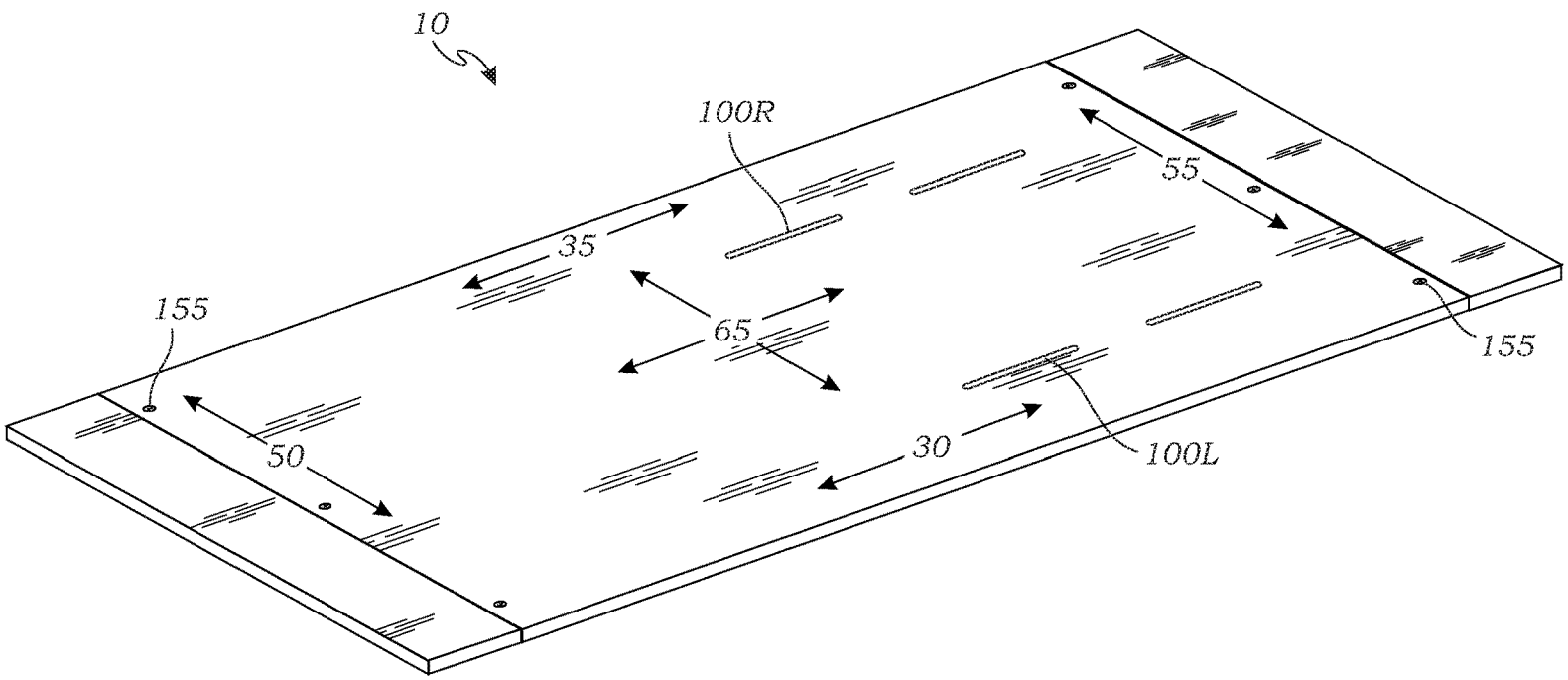
FIG. 3 is a bottom perspective view of a deck in accordance with an embodiment of the present invention.

Turning now to FIG. 3, a bottom perspective view of deck 10 is shown in accordance with an embodiment of the present invention. To achieve a purpose of the invention, bottom surface 65 of deck 10 is configured to receive any pair of angled supports 15 such that merchandising system 5 may be placed/installed on a shelf 145 (FIG. 8) to allow deck 10 to rest at any target angle corresponding to any pair of angled supports 15, and thus present merchandise at such angle accordingly. Various angles may be desired for aesthetics, accessibility, gravity-feed strength, loss prevention, or any other reason. For example, a first pair of angled supports 15L(10) and 15R(10) may be configured to support deck 10 at a first non-zero angle such as 10 degrees, and a second pair of angled supports 15L(8) and 15R(8) may be configured to support deck 10 at a second non-zero angle different than the first non-zero angle such as 8 degrees. Other pairs of angled supports may be configured to support deck 10 at other non-zero angles such as 4 degrees, 6 degrees, and 12 degrees respectively (see FIG. 6A).

Figure 4A:
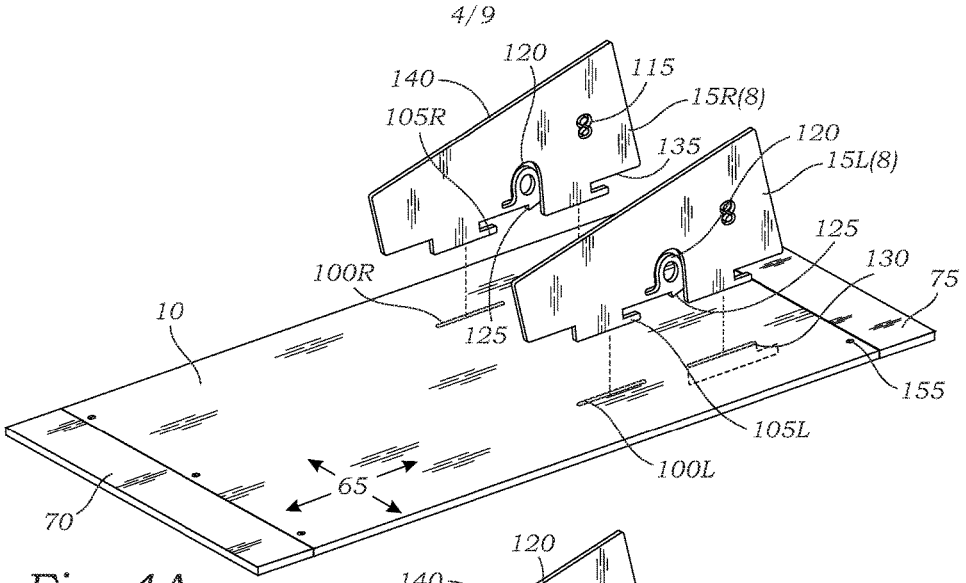
FIG. 4A is a bottom perspective exploded view of the deck of FIG. 3, showing a pair of angled supports.
Figure 4B:
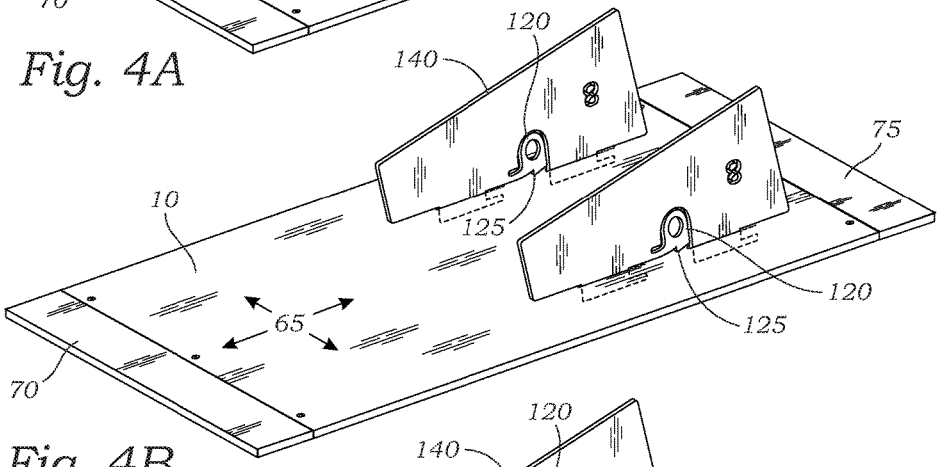
FIG. 4B is a bottom perspective view of the deck and angled supports of FIG. 4*a*, showing the angled supports inserted into the bottom surface of the deck.
Figure 4C:
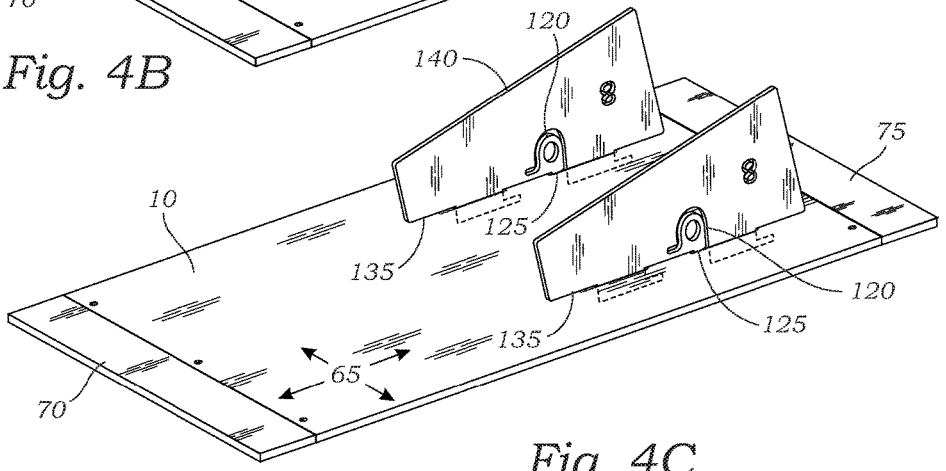
FIG. 4C is a bottom perspective view of the deck and angled supports of FIG. 4*a*, showing the angled supports installed onto the bottom surface of the deck.

An angled support 15 may be attached to bottom surface 65 of deck 10 in any suitable manner, but in one embodiment of the present invention, bottom surface 65 of deck 10 has a slot 100L on the left side 30 configured to receive a leg 105L extending from one angled support (e.g., 15L(8)), and a slot 100R on the right side 35 configured to receive a leg 105R extending from another angled support (e.g., 15R(8)). In another embodiment, an angled support 15 has two legs 105, and bottom surface 65 of deck 10 is configured to receive both legs 105 of angled support 15, either in a single slot 100, or in two slots 100 as seen in FIGS. 3, 4A-4C, and 5. In the embodiment in which angled supports 15 have two legs 105 each, each angled support 15 may be installed (removably attached) into slots 100 as seen in FIGS. 4Aa, 4B, and 4C in sequence. In this example, legs 105 are manually press fitted into slots 100 then slid forward (or backward as the case may be) to catch under lip portions 130 of slots 100. Specifically, FIG. 4A shows an exploded view before angled supports 15 are inserted. FIG. 4B shows legs 105 of angled supports 15 inserted into slots 100. FIG. 4C shows legs 105 then installed (securely but removably attached) by sliding backward to catch and "lock" under lips 130 of slots 100. An angled support 15 may have more than two legs 105 (e.g., 3, 4, 5, 6, 7, 8, 9, or more), and bottom surface 65 of deck 10 would be configured to accept all such legs 105 in one or more corresponding slots 100.

Figure 5:
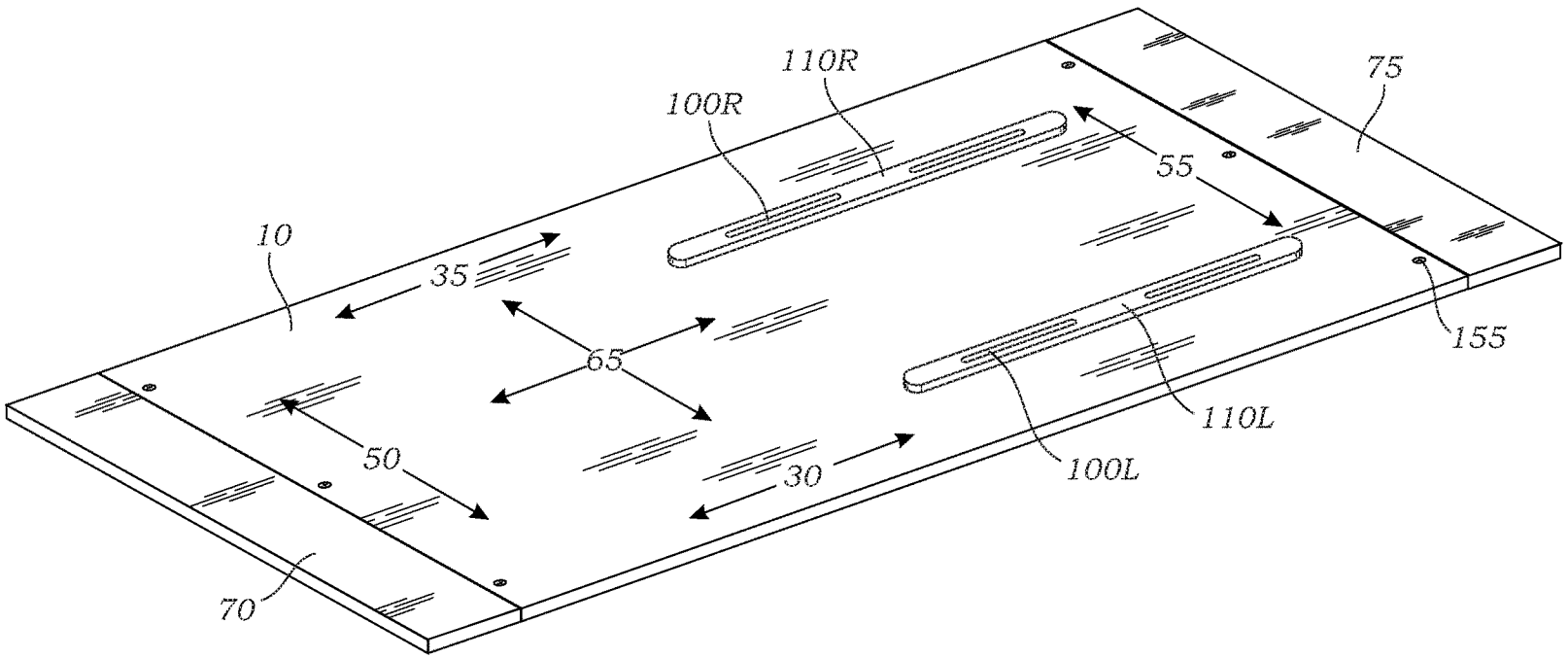
FIG. 5 is a bottom perspective view of a deck in accordance with an alternative embodiment of the present invention.

In another embodiment of the present invention as seen in FIG. 5, bottom surface 65 of deck 10 has left and right rails 110L and 110R respectively attached thereto with corresponding slots 100L and 100R instead of slots being formed directly into bottom surface 65 of deck 10. In all embodiments, legs 105 may be removably attached to bottom surface 65 of deck 10 by press-fitting, slide-locking, snapping, clipping, or any other suitable manner. One such mechanism suitable for the embodiment with rails 110 is a plastic barbed channel lock manufactured by Lockdowel, Inc. of Fremont, Calif., SKU E900BPMini.

Figure 6A:
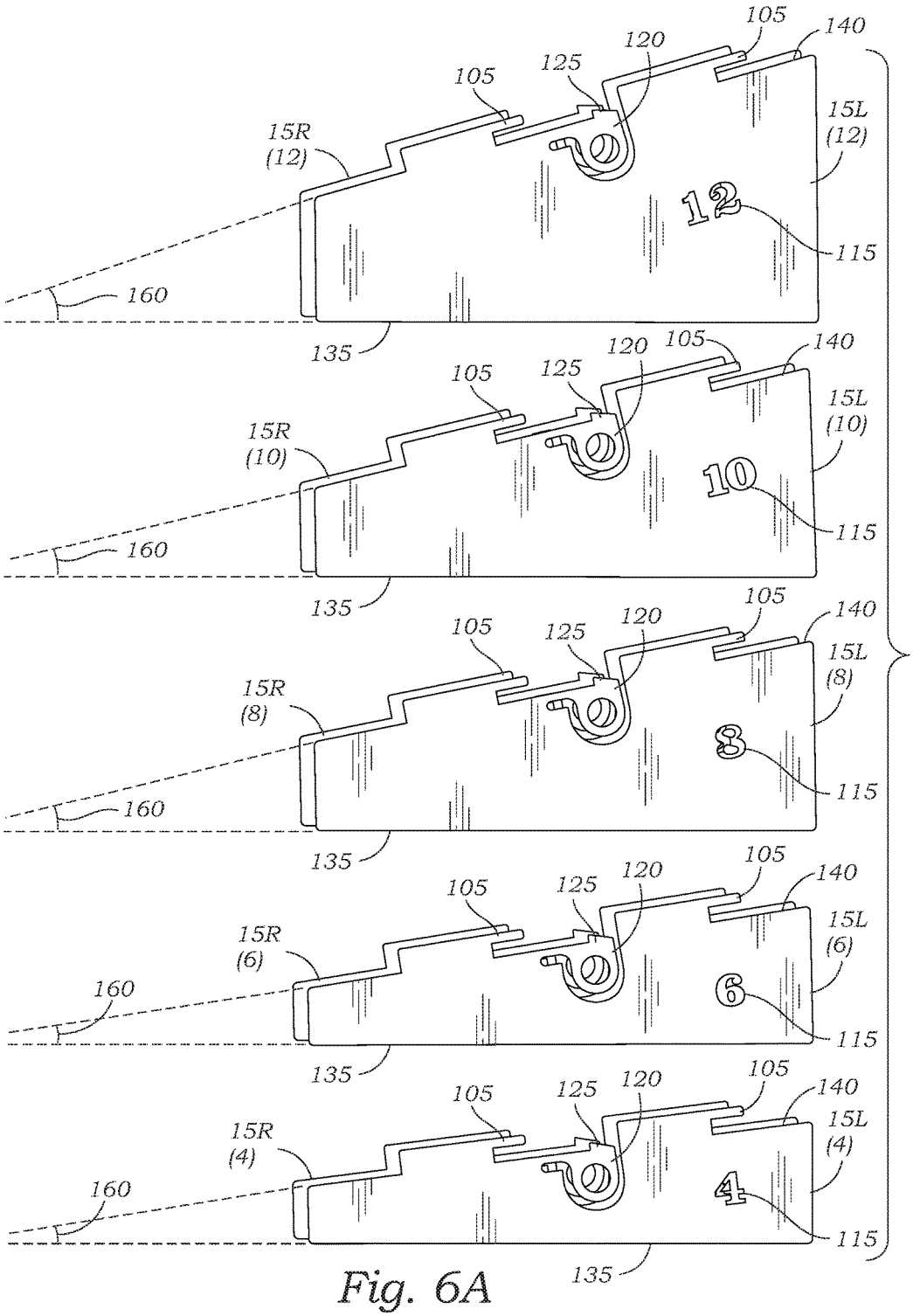
FIG. 6A is a perspective view of five angled supports configured for five separate target angles respectively.

Turning now to FIG. 6A, five pairs of angled supports 15 are shown. Multiple pairs of angled supports 15 should be part of each merchandising system 5 in accordance with the present invention, configured to support deck 10 at angles ranging from approximately 4 degrees to approximately 12 degrees. Each pair consists of a left support 15L(x) and a right support 15R(x), which will typically be identical to each other in all material respects and thus interchangeable. Supports 15 may have angle indicia 115 indicating the target angle at which deck 10 will be positioned when such supports 15 are used in accordance with the present invention. Indicia 115 may be cutouts in supports 15 as seen in FIG. 6A, where the cutouts "4" "6" "8" "10" and "12" represent 4, 6, 8, 10, and 12 degrees respectively. In other words, if supports 15(8) are used, deck 10 would be at an 8 degree angle. Likewise if supports 15(4), 15(6), 15(10), or 15(12) are used, deck 10 would be at 4 degrees, 6 degrees, 10 degrees, and 12 degrees respectively. Indicia 115 may be painted on, engraved, printed on stickers, etc., and may be numbers, words, pictures, graphics, etc.

Supports 15 shown in FIG. 6A include two legs 105 each, and a pull ring 120. Pull ring 120 has a catch 125 near the top. In one embodiment as seen in FIGS. 4A-4C in which bottom surface 65 of deck 10 has two slots 100 for each angled support 15, catch 125 is configured to slide into one of the slots 100 as legs 105 slide backward and "lock" under lips 130, such that legs 105 cannot thereafter be slid back out of slots 100 without catch 125 being lifted away from bottom surface 65 of deck 10. To do so, pull ring 120 is lifted away from bottom surface 65 of deck 10, which lifts catch 125 away accordingly. Once catch 125 is out of slot 100, angled support 15 may then be slid forward to free legs 105 from under lips 130 so angled support 15 may be removed and replaced as needed with different angled support 15, e.g., to set deck 10 at a new angle.

Angled supports 15 each have a straight bottom edge 135 and a straight top edge 140 at a non-zero angle 160 (see FIG. 6A) relative to bottom edge 135. It is this non-zero angle 160 that represents the angle at which deck 10 will rest when placed on shelf 145, presuming shelf 145 is at zero degrees to the horizontal. Thus, as described herein, each angled support 15 is configured to be removably secured to bottom surface 65 of deck 10 such that its straight top edge 140 is substantially flush therewith (see FIG. 4C), whereby when a pair of corresponding angled supports 15 is removably secured to bottom surface 65 of deck 10, deck 10 is at the non-zero angle 160 associated with such pair. In this manner, a matching pair of angled supports 15 can be used to set deck 10 at the target angle associated with such pair when system 5 is placed on shelf 145. Accordingly, with multiple pairs of angled supports (e.g., as seen in FIG. 6A), deck 10 may be set to correspondingly multiple angles by simply replacing one pair of angled supports 15 having a first target angle, with another pair having a different target angle.

Figure 6B:
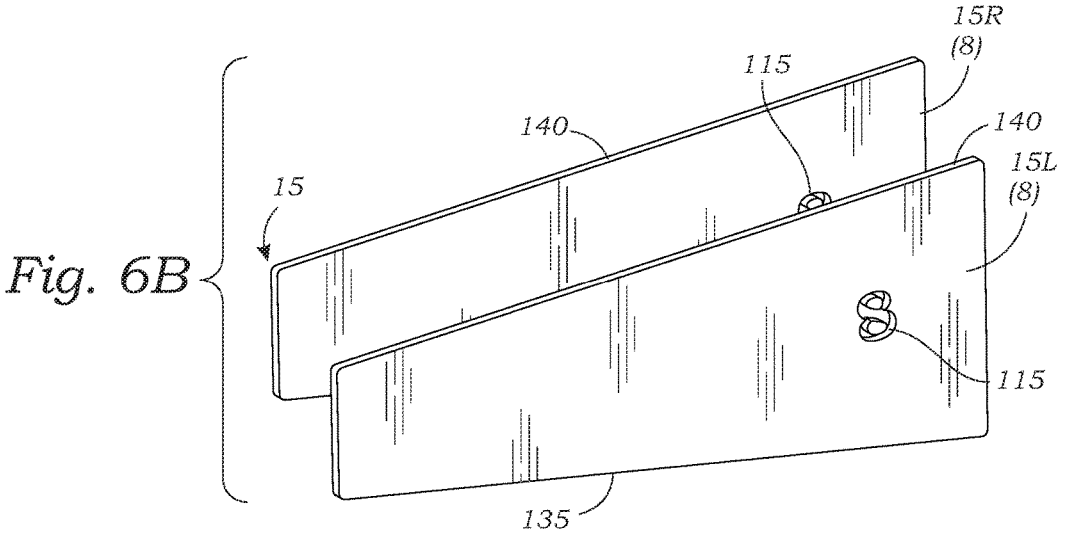
FIG. 6B is a perspective view of an alternative embodiment of a pair of angled supports.

In alternative embodiments of the present invention, angled supports 15 may have a profile as seen in FIG. 6B without legs 105, pull ring 120, or catch 125. For example, in embodiments with rails 110 on bottom surface 65 of deck 10, such features would not be useful and/or necessary because angled supports 15 without such features could be secured with the aforementioned Lockdowel, Inc. barbed channel lock mechanism.

Figure 7:
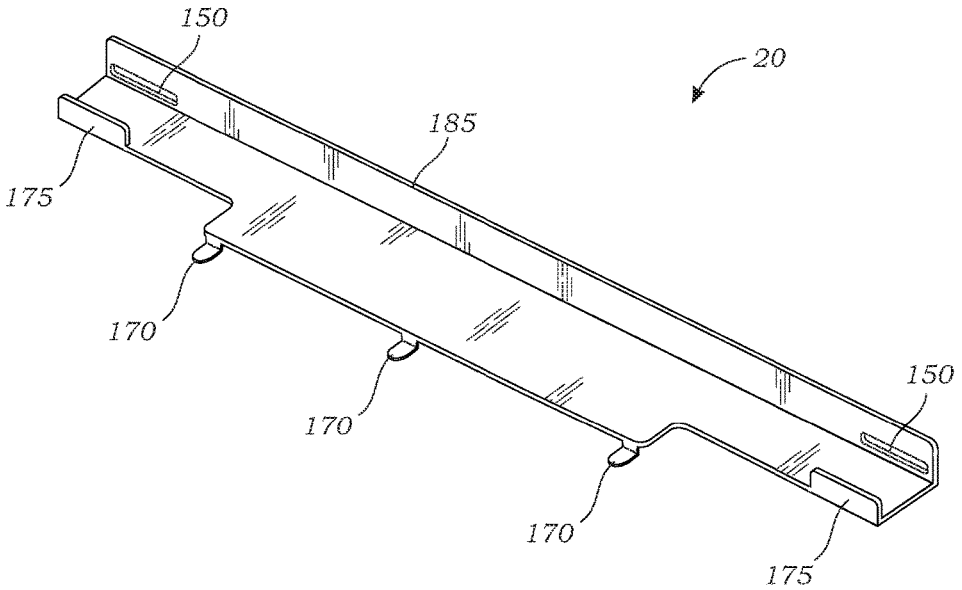
FIG. 7 is a back perspective view of a front stop in accordance with an embodiment of the present invention.

Turning now to FIG. 7, a front stop 20 is shown in accordance with an embodiment of the present invention. Front stop 20 may be a single integrated piece, as seen in FIG. 7, or may include multiple pieces, in which case typically the pieces would be preassembled as part of the factory assembly process. Front stop 20 may be removably attachable to deck 10, or may be permanently attached thereto or even manufactured (machined, molded, cut, printed, etc.) as an integrated portion of deck 10. Front stop 20 may be made of plastic, metal, glass, rubber, and/or any other suitable material(s). Front stop 20 may have tabs 170 for removably attaching front stop 20 to shelf 145 through holes 180 in shelf 145, and/or may be removably attachable to shelf 145 by magnets, screws, and/or other suitable means. Tabs 170 extend from back of front stop 20 as seen in FIG. 7, so after insertion of tabs 170 into shelf holes 180 with front stop 20 at a slight angle to allow such insertion, front stop 20 is rotated downward to rest snugly on shelf 145. Front stop 20 may have additional tabs (not shown) extending perpendicular to bottom surface of front stop 20, for insertion into additional holes 180 of shelf 145 for further securement. Once secured, a guard rail portion 185 of front stop 20 extends vertically upward relative to shelf 145 to retain merchandise on deck 10 as merchandise is fed forward. Guard rail portion 185 is typically 2, 3, or 4 inches tall, but may be any height. Deck 10 is configured to be removably attached to front stop 20 at front panel 70 of deck 10. For example, front stop 20 has slots 150 for receiving tabs 95 of front panel 70 of deck 10, and additional tabs 175 extending vertically upward to mate with corresponding slots (not shown) on bottom side of front portion 70 of deck 10 for further securement of deck 10 to front stop 20.

Figure 8:
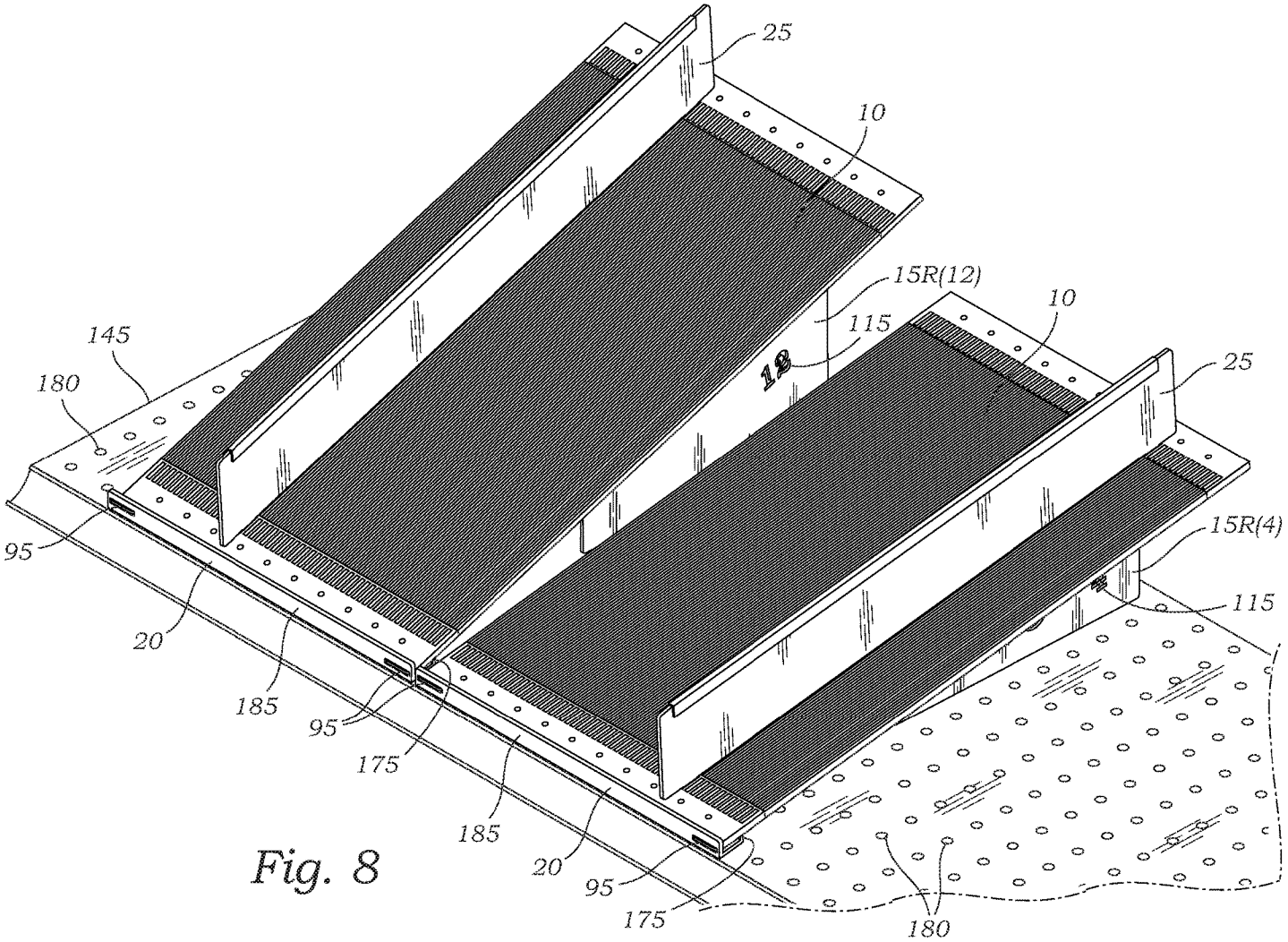
FIG. 8 is a perspective view of two assembled merchandising units in accordance with an embodiment of the present invention, in use on a shelf.

Referring now to FIG. 8, two fully-assembled merchandising units 5 in accordance with an embodiment of the present invention are shown installed on shelf 145. One unit is positioned at a 12 degree angle as seen by angle indicia 115 in angled support 15R(12) in the form of a "12" cutout. The other unit is positioned at a 4 degree angle as seen by angle indicia 115 in angled support 15R(4) in the form of a "4" cutout. This example thus shows two units 5 installed on the same shelf 145 at different target angles. Each unit 5 is shown with only a single divider 25, though multiple dividers 25 may be used as needed. Dividers 25 are removably attached to top surface 60 of deck 10 by mating divider connectors 85*f* (e.g., tabs) with complimentary connectors 80*f* (e.g., slots) on front and back panels 70 and 75. Dividers 25 are shown with guards 165 along their upper edges for extra protection and rigidity. Guards 165 may be plastic, metal, rubber, and/or any other suitable material. Dividers 25 are typically 1, 2, or 3 inches tall, but may be any height.

Figure 9:
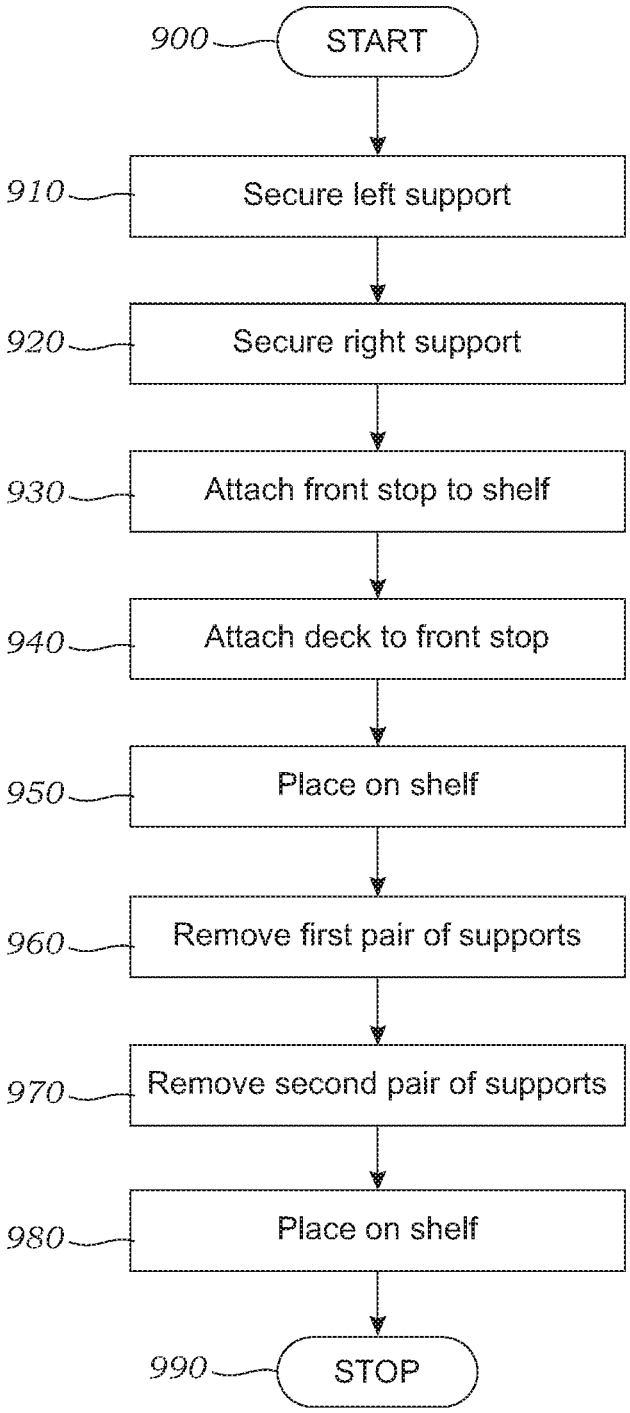
FIG. 9 is a flowchart showing a method in accordance with an embodiment of the present invention.

Turning now to FIG. 9, a flowchart shows a method in accordance with an embodiment of the present invention, to install a merchandising system 5 as described herein on a shelf 145 having a top surface. The method starts at Step 900. At Step 910 an angled support 15L(x) is removably secured to left side 30 of bottom surface 65 of deck 10 as described herein, and at Step 920 an angled support 15R(x) is likewise removably secured to right side 35 of bottom surface 65 of deck 10. Angled supports 15L(x) and 15R(x) allow unit 5 to rest on a top surface of shelf 145 at a non-zero angle x 160 relative to top surface of shelf 145. In embodiments that do not include front stop 20, the method skips Steps 930 and 940, and the unit 5 is simply placed on shelf 145 at Step 950 such that straight bottom edges 135 of angled supports 15L(x) and 15R(x) rest on top surface of shelf 145, resulting in deck 10 being positioned at the non-zero angle x 160 relative to the top surface of shelf 145. In embodiments that include front stop 20, front stop 20 is removably attached to shelf 145 at Step 930 as described herein, and in embodiments in which front stop 20 is not an integrated portion of deck 10, deck 10 is removably attached to front stop 20 at Step 940 as described herein. Although it may be more practical to perform Steps 910-950 in the order described, Steps 910-950 may be performed in any order. The method may then skip Steps 960, 970, and 980, to end at Step 990.

But to change the non-zero target angle 160 from an angle x to another angle y, angled supports 15L(x) and 15R(x) are detached from bottom surface 65 of deck 10 at Step 960, and replaced with a different pair of angled supports 15L(y) and 15R(y) at Step 970, configured to achieve the new target angle y 160. The unit 5 with new angled supports 15L(y) and 15R(y) attached thereto is then placed back on shelf 145 at Step 980. This may include reattaching deck 10 to front stop 20 if deck 10 was removed form front stop 20, and reattaching front stop 20 to shelf 145 if front stop 20 was removed from shelf 145. In this manner, a unit 5 may be efficiently adjusted to any desired target angle 160 thus allowing merchandise to be presented at such angle, without having to replace an entire shelf 145. With multiple units 5 on a shelf 145, this also allows only desired sections of shelf 145 to be reconfigured as opposed to having to reconfigure an entire shelf 145.

What is claimed is:

1. A merchandising system comprising:

a deck having a left side, a left edge, a right side, a right edge, a front, a back, a top surface and a bottom surface;

a first pair of supports comprising a first left support and a first right support, each having a first straight bottom edge and a first straight top edge at a first non-zero angle relative to the first straight bottom edge;

a second pair of supports comprising a second left support and a second right support each having a second straight bottom edge and a second straight top edge at a second non-zero angle relative to the second straight bottom edge, the second non-zero angle being different than the first non-zero angle; and a front stop configured to be removably attached to a shelf and to the front of the deck, and to extend vertically upward relative to the shelf when attached to the shelf and to the front of the deck; and a merchandise divider configured to be removably attached to the top surface of the deck;

wherein the first left support is configured to be removably secured to the left side of the bottom surface of the deck such that the first straight top edge of the first left support is substantially flush with the left side of the bottom surface of the deck, and the first right support is configured to be removably secured to the right side of the bottom surface of the deck such that the first straight top edge of the first right support is substantially flush with the right side of bottom surface of the deck, whereby when the first left support is removably secured to the left side of the bottom surface of the deck and the first right support is removably secured to the right side of the bottom surface of the deck, the deck is at the first non-zero angle; and wherein the second left support is configured to be removably secured to the left side of the bottom surface of the deck such that the second straight top edge of the second left support is substantially flush with the bottom surface of the deck, and the second right support is configured to be removably secured to the right side of the bottom surface of the deck such that the second straight top edge of the second right support is substantially flush with the right side of bottom surface of the deck, whereby when the second left support is removably secured to the left side of the bottom surface of the deck and the second right support is removably secured to the right side of the bottom surface of the deck, the deck is at the second non-zero angle.

2. The merchandising system of claim 1, wherein the top surface of the deck has a front connector at the front of the deck and a back connector at the back of the deck, the divider has a front connector and a back connector, and the front and back connectors of the divider are configured to mate with the front and back connectors of the deck respectively to removably attach the divider to the top surface of the deck.

3. The merchandising system of claim 2, wherein the top surface of the deck has a plurality of front connectors at the front of the deck and a plurality of corresponding back connectors at the back of the deck, and the top surface of the deck has front alignment indicia at the front of the deck and corresponding back alignment indicia at the back of the deck, such that attachment of the front connector of the divider to one of the plurality of front connectors of the deck at a position relative to the front alignment indicia and attachment of the back connector of the divider to the corresponding back alignment indicia aligns the divider along the top surface of the deck in parallel relation to the left and right edges of the deck.

4. The merchandising system of claim 1 wherein the left side of the bottom surface of the deck has a slot and the right side of the bottom surface of the deck has a slot, and wherein the first left support has a leg configured to be removably secured into the slot of the left side of the bottom surface of the deck, the first right support has a leg configured to be removably secured into the slot of the right side of the bottom surface of the deck, the second left support has a leg configured to be removably secured into the slot of the left side of the bottom surface of the deck, and the second right support has a leg configured to be removably secured into the slot of the right side of the bottom surface of the deck.

5. The merchandising system of claim 4, wherein the left side of the bottom surface of the deck has a second slot and the right side of the bottom surface of the deck has a second slot, and wherein the first left support has a second leg configured to be removably secured into the second slot of the left side of the bottom surface of the deck, the first right support has a second leg configured to be removably secured into the second slot of the right side of the bottom surface of the deck, the second left support has a second leg configured to be removably secured into the second slot of the left side of the bottom surface of the deck, and the second right support has a second leg configured to be removably secured into the second slot of the right side of the bottom surface of the deck.

6. The merchandising system of claim 1, further comprising a left rail attached to the bottom surface of the deck on the left side and having a slot therein, and a right rail attached to the bottom surface of the deck on the right side and having a slot therein, and wherein the first left support has a leg configured to be removably secured into the slot of the left rail, the first right support has a leg configured to be removably secured into the slot of the right rail, the second left support has a leg configured to be removably secured into the slot of the left rail, and the second right support has a leg configured to be removably secured into the slot of the right rail.

7. The merchandising system of claim 6, wherein the left rail has a second slot and the right rail has a second slot, and wherein the first left support has a second leg configured to be removably secured into the second slot of the left rail, the first right support has a second leg configured to be removably secured into the second slot of the right rail, the second left support has a second leg configured to be removably secured into the second slot of the left rail, and the second right support has a second leg configured to be removably secured into the second slot of the right rail.

8. The merchandising system of claim 1, wherein the first non-zero angle and the second non-zero angle are both selected from the group consisting of: 4 degrees; 6 degrees; 8 degrees; 10 degrees; and 12 degrees.

9. The merchandising system of claim 1, wherein the first non-zero angle and the second non-zero angle are both angles in the range between approximately 4 degrees and approximately 12 degrees.

10. The merchandising system of claim 1, wherein the first left support and the first right support have angle indicia corresponding to the first non-zero angle, and the second left support and the second right support have angle indicia corresponding to the second non-zero angle.

11. A merchandising system comprising:

a deck having a left side, a left edge, a right side, a right edge, a front, a back, a top surface and a bottom surface;

a first pair of supports comprising a first left support and a first right support, each having a first straight bottom edge and a first straight top edge at a first non-zero angle relative to the first straight bottom edge; and a second pair of supports comprising a second left support and a second right support each having a second straight bottom edge and a second straight top edge at a second non-zero angle relative to the second straight bottom edge, the second non-zero angle being different than the first non-zero angle;

wherein the first left support is configured to be removably secured to the left side of the bottom surface of the deck such that the first straight top edge of the first left support is substantially flush with the left side of the bottom surface of the deck, and the first right support is configured to be removably secured to the right side of the bottom surface of the deck such that the first straight top edge of the first right support is substantially flush with the right side of bottom surface of the deck, whereby when the first left support is removably secured to the left side of the bottom surface of the deck and the first right support is removably secured to the right side of the bottom surface of the deck, the deck is at the first non-zero angle;

wherein the second left support is configured to be removably secured to the left side of the bottom surface of the deck such that the second straight top edge of the second left support is substantially flush with the bottom surface of the deck, and the second right support is configured to be removably secured to the right side of the bottom surface of the deck such that the second straight top edge of the second right support is substantially flush with the right side of bottom surface of the deck, whereby when the second left support is removably secured to the left side of the bottom surface of the deck and the second right support is removably secured to the right side of the bottom surface of the deck, the deck is at the second non-zero angle;

wherein the left side of the bottom surface of the deck has a slot and the right side of the bottom surface of the deck has a slot, and wherein the first left support has a leg configured to be removably secured into the slot of the left side of the bottom surface of the deck, the first right support has a leg configured to be removably secured into the slot of the right side of the bottom surface of the deck, the second left support has a leg configured to be removably secured into the slot of the left side of the bottom surface of the deck, and the second right support has a leg configured to be removably secured into the slot of the right side of the bottom surface of the deck;

wherein the left side of the bottom surface of the deck has a second slot and the right side of the bottom surface of the deck has a second slot, and wherein the first left support has a second leg configured to be removably secured into the second slot of the left side of the bottom surface of the deck, the first right support has a second leg configured to be removably secured into the second slot of the right side of the bottom surface of the deck, the second left support has a second leg configured to be removably secured into the second slot of the left side of the bottom surface of the deck, and the second right support has a second leg configured to be removably secured into the second slot of the right side of the bottom surface of the deck; and wherein the first left support has a pull ring with a catch configured to be removably secured into the second slot of the left side of the bottom surface of the deck when the second leg of the first left support is removably secured into the second slot of the left side of the bottom surface of the deck, and the first right support has a pull ring with a catch configured to be removably secured into the second slot of the right side of the bottom surface of the deck when the second leg of the first right support is removably secured into the second slot of the right side of the bottom surface of the deck.

12. The merchandising system of claim 11, further comprising a front stop configured to be removably attached to a shelf and to the front of the deck, and to extend vertically upward relative to the shelf when attached to the shelf and to the front of the deck.

13. The merchandising system of claim 12, wherein the front stop has slots and the deck has deck tabs at the front, and the slots are configured to mate with the deck tabs to removably attach the front stop to the front of the deck.

14. The merchandising system of claim 11, further comprising a front stop integrated into the front of the deck and configured to be removably attached to a shelf and to extend vertically upward relative to the shelf when attached to the shelf.

15. The merchandising system of claim 11, wherein the first left support and the first right support have angle indicia corresponding to the first non-zero angle, and the second left support and the second right support have angle indicia corresponding to the second non-zero angle.

16. The merchandising system of claim 11, wherein the first non-zero angle and the second non-zero angle are both selected from the group consisting of: 4 degrees; 6 degrees; 8 degrees; 10 degrees; and 12 degrees.

17. The merchandising system of claim 11, wherein the first non-zero angle and the second non-zero angle are both angles in the range between approximately 4 degrees and approximately 12 degrees.

18. The merchandising system of claim 11, wherein the first left support and the first right support have angle indicia corresponding to the first non-zero angle, and the second left support and the second right support have angle indicia corresponding to the second non-zero angle.

* * * * *